US006705834B1

(12) United States Patent
Jacobsson

(10) Patent No.: US 6,705,834 B1
(45) Date of Patent: Mar. 16, 2004

(54) AXIAL FLOW TURBINE TYPE ROTOR MACHINE FOR ELASTIC FLUID OPERATION

(75) Inventor: Rolf Alexis Jacobsson, Hemvaägen (SE)

(73) Assignee: Atlas Copco Tools AB, Nacka (SE)

( * ) Notice: Subject to any disclaimer, the term of this patent is extended or adjusted under 35 U.S.C. 154(b) by 93 days.

(21) Appl. No.: 10/149,733

(22) PCT Filed: Nov. 1, 2000

(86) PCT No.: PCT/SE00/02151

§ 371 (c)(1),
(2), (4) Date: Jun. 13, 2002

(87) PCT Pub. No.: WO01/44623

PCT Pub. Date: Jun. 21, 2001

(30) Foreign Application Priority Data

Dec. 16, 1999 (SE) ..... 99046039

(51) Int. Cl.[7] ..... F01D 5/14; F01D 9/02

(52) U.S. Cl. ..... 415/193; 415/199.5; 416/193 A

(58) Field of Search ..... 415/193, 199.4, 415/199.5, 216.1, 232, 914; 416/189, 193 A, 248

(56) References Cited

U.S. PATENT DOCUMENTS 778,499 A * 12/1904 Meden ..... 415/199.5
1,749,528 A * 3/1930 Freudenreich et al. ..... 416/248
5,397,215 A 3/1995 Spear et al.
5,447,413 A * 9/1995 Maier et al. ..... 415/199.5
6,283,713 B1 * 9/2001 Harvey et al. ..... 416/193 A

FOREIGN PATENT DOCUMENTS

EP 0846867 6/1998
EP 0943784 9/1999

* cited by examiner

*Primary Examiner*—Edward K. Look
*Assistant Examiner*—Richard A. Edgar
(74) *Attorney, Agent, or Firm*—Frishauf, Holtz, Goodman & Chick, P.C.

(57) ABSTRACT

An axial flow turbine machine intended for elastic fluid operation is provided which includes a rotor with two or more sections each carrying an array of radially directed drive blades, and a stator having a number of fluid inlet nozzles and one or more sections each carrying a circumferential array of guide vanes for directing motive fluid onto the drive blades. A rotor flow path is formed between every two adjacent drive blades in each rotor section and a stator flow path is formed between every two adjacent guide vanes in each stator section. A widened section is provided between the entrance section and the exit section of each rotor section flow path and each stator section flow path, such that the radial distance between the inner flow path defining surface and the outer flow path defining surface is larger in the widened section than in the exit section.

12 Claims, 3 Drawing Sheets

AXIAL FLOW TURBINE TYPE ROTOR MACHINE FOR ELASTIC FLUID OPERATION

CROSS REFERENCE TO RELATED APPLICATION

This application is a U.S. National Phase Application under 35 U.S.C. 371 of International Application No. PCT/SE00/02151 filed Nov. 1, 2000.

BACKGROUND OF THE INVENTION

The invention relates to an axial flow turbine type rotor machine which is intended for elastic fluid operation. The turbine type machine includes a rotor having one or more axially spaced sections each comprising a circumferential array of radially extending drive blades, and a stator having two or more axially spaced sections each comprising a circumferential array of radially extending guide vanes. Each one of the stator sections is located on opposite sides of the rotor sections, and a flow path is formed between every two adjacent drive blades in each rotor section, and between every two adjacent guide vanes in each stator section. Each one of the flow paths has a certain length and extends between an entrance region and an exit region.

Turbine type machines of this type, for instance gas turbines of the above mentioned type, have in general a limited efficiency due to flow losses in the flow paths of the rotor and the stator. Big gas turbine motors, having a power output of some thousand kilowatts, often reach a maximum efficiency of above 90%. Mid size gas turbines motors, however, having a power output up to a few hundred kilowatts, reach a maximum efficiency of no more than 85%. This is considered to be too low efficiency for making gas turbines in this size range interesting for certain applications.

SUMMARY OF THE INVENTION

It is the main object of the invention to provide and axial flow turbine type rotor machine for elastic fluid operation, wherein the flow losses through the rotor and stator flow paths are substantially reduced and the efficiency of the turbine is substantially increased.

Characteristic features as well as further advantages of the invention will appear from the following detailed description of preferred embodiments of the invention and from the accompanying drawings.

DETAILED DESCRIPTION

Figure 1:
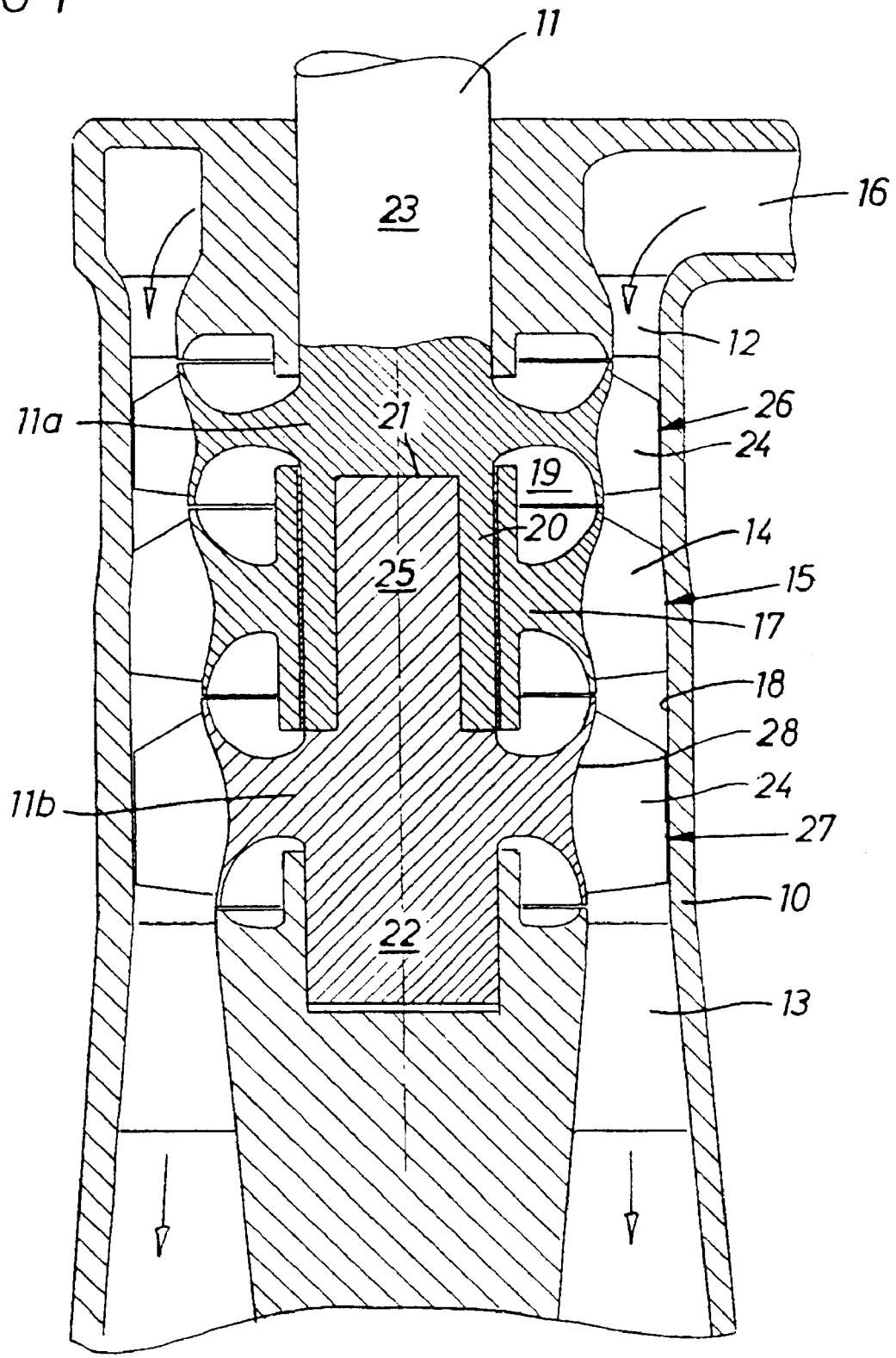
FIG. 1 shows a longitudinal sectional view through a turbine machine according to the invention.

The turbine machine examples described below in detail are suitable mainly as gas turbine motors. Looking first at the example shown FIG. 1, the turbine machine comprises a stator housing 10 and a rotor 11. The stator housing 10 is of a substantially cylindrical shape and is provided at one end with a number of gas inlet nozzles 12 communicating with a gas inlet 16 and a funnel shaped outlet diffusor 13 at the opposite end. The stator housing 10 is also provided with a number of guide vanes 14 which are arranged in an annular section 15 and which form a circumferential array. The guide vanes 14 are mounted on an inner ring structure 17 and are supported by their outer ends against a substantially cylindrical surface 18 of the stator housing 10. The ring structure 17 is received in a peripheral space 19 in the rotor 11 and is arranged to co-operate with a cylindrical waist portion 20 on the rotor 11 to form a seal.

The rotor 11 comprises a forward part 22 and a rear part 23 and is journalled relative to the stator housing 10 by two bearings which are not illustrated. The rotor 11 comprises two axially spaced operating sections 26, 27 each carrying a circumferential array of drive blades 24. The two operating sections 26, 27 are separated by the annular stator section 15. An inner surface 28 formed by the rotor operating sections 26,27 as well as by the stator ring 17 tapers slowly towards the outlet diffusor 13 so as to make the gas flow expand as it passes through the turbine.

Figure 2:
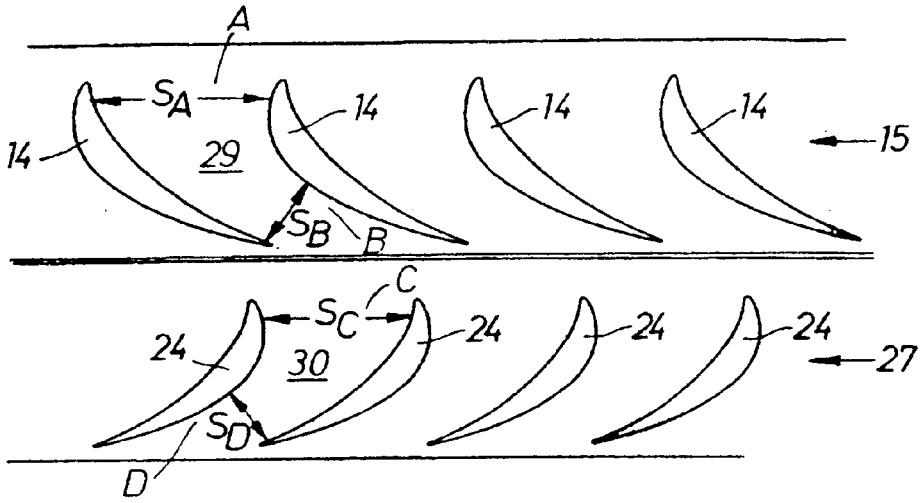
FIG. 2 shows schematically a spread-out view of a number of drive blades of one rotor section and a number of guide vanes of one stator section of the turbine machine shown in FIG. 1.

As shown in FIG. 2, between two adjacent guide vanes 14 in each array there is formed a stator flow path 29 having an entrance region A with a distance $S_A$ between adjacent guide vanes 14 and an exit region B with a distance $S_B$ between the guide vanes 14. Both distances $S_A$ and $S_B$ are measured transversely to the stator flow path 29. As clearly illustrated in FIG. 2, the distance $S_A$ is considerably larger than distance $S_B$, which means that the cross sectional area of the stator flow path 29 generally decreases from the entrance region A to the exit region B.

In a similar way, two adjacent drive blades 24 in each array define a rotor flow path 30 in which the width $S_C$ at the entrance region C is larger than the width $S_D$ at the exit region D, which means that each rotor flow path 30 has a decreasing cross sectional area towards the exit region D.

Figure 3:
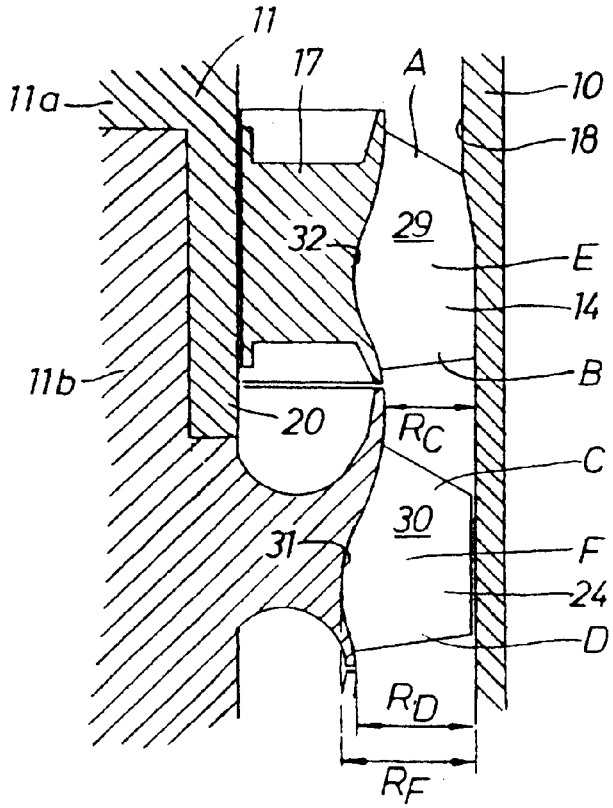
FIG. 3 shows, on a larger scale, a detail view of one guide vane and one drive blade of a turbine machine according to one embodiment of the invention.

As illustrated in FIG. 3, the rotor flow path 30 comprises a radially widened region F located between the entrance region C and the exit region D. In the described example, this widened region F is formed by a concave portion 31 in the inner surface 28. In this widened region F the radial extent $R_F$ of the drive blade 24 is larger than the radial extent $R_D$ of the drive blade 24 in the exit region D. This means that the cross sectional area of the flow path 29 is kept up in size close to the exit region D, which results in a lower gas velocity upstream of the exit region D and, hence, lower flow losses in the flow path 30.

A similar arrangement is provided in each stator flow path 29 where a concave portion 32 is located in the ring structure 17 between the entrance region A and the exit region B and forms a widened region E. The radial extent of the guide vane 14 is larger in the widened region E than in the exit region B. It should be observed that the ring structure 17 is received in the waist portion 20 of the rotor 11.

In FIG. 3, it is clearly shown that the concave portion 31 in the rotor 11 forms a radially widened region F in which the radial extent $R_F$ of the drive blade 24 is larger than the radial extent $R_D$ in the exit region D. The radial extent $R_C$ in the entrance region C is even smaller than the radial extent $R_D$ in the exit region D.

The arrangement of radially widened regions E and F in the stator flow paths 29 and rotor flow paths 30, respectively, are effective in keeping down the fluid flow velocity through the flow paths 29,30 and, thereby, the flow losses. The radial extent of the drive blades 24 and the guide vanes 14 should be at least 5% larger in the widened regions E, F than in the exit regions B, D of the flow paths 29, 30 for obtaining a positive effect. In order to get a significant increase of the turbine efficiency, though, the difference in radial extent should be considerably larger than that.

However, the percentage of increase of the drive blade/guide vane radial extent in the widened regions depends on the relationship between the radial extent and the length of the respective drive blade or guide vane, such that a drive blade or guide vane having a short length but a large radial extent must be combined with a relatively smaller concave portion so as to avoid too large and abrupt area changes of the flow paths.

Employment of radially widened flow path regions according to the invention is particularly beneficial in turbines having drive blades and guide vanes with a small radial extent and a considerable length. In such turbines the radial extent of the drive blades and guide vanes in the widened regions may be 10–20% larger than the radial extent of the drive blades and guide vanes in the exit regions.

According to the invention, the radially widened regions of the flow paths through the rotor sections as well as the stator sections shall extend over at least 60%, preferably 80% of the flow path length, such that the fluid flow velocity is kept down during the main part of the flow path length. A low flow velocity gives low internal flow losses. At the very end of the flow paths, there is a reduction in cross sectional area which results in a rapid acceleration of the fluid flow.

Figure 4:
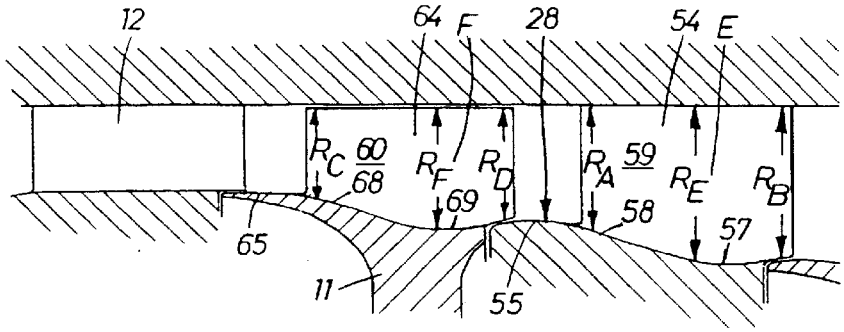
FIG. 4 shows a detail view of a drive blade/guide vane arrangement in a turbine machine according to another embodiment of the invention.
Figure 5:
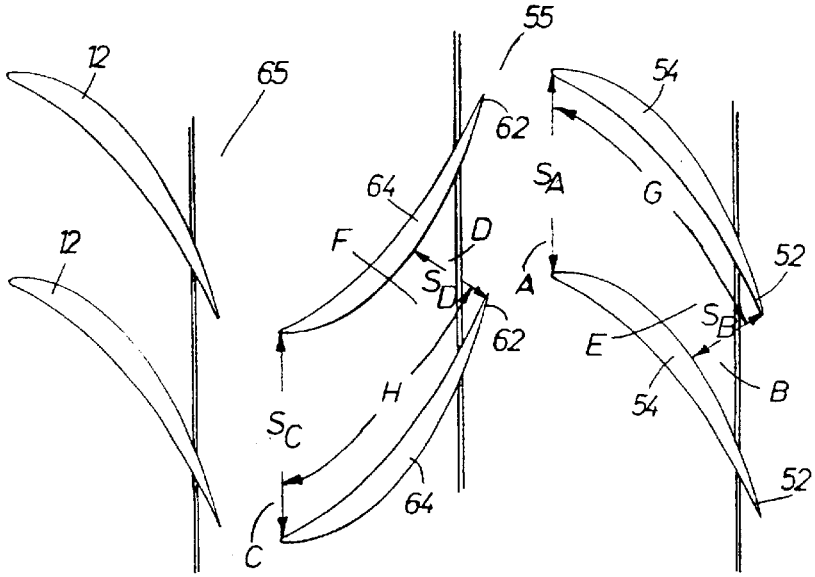
FIG. 5 shows a spread-out view of the drive blade/guide vane arrangement shown in FIG. 4.
Figure 6:
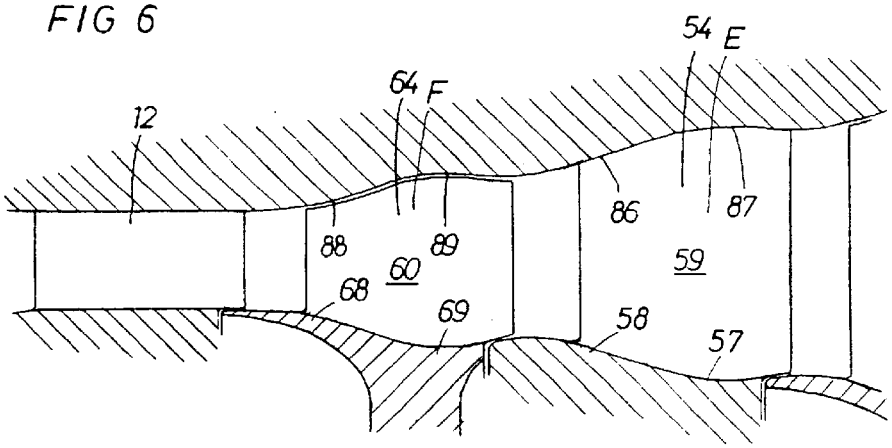
FIG. 6 shows a drive blade/guide vane arrangement according to still another embodiment of the invention.

In order to further reduce the internal flow losses and increase the efficiency of the turbine machine, the embodiment of the invention shown in FIGS. 4, 5 and 6 comprises a drive blade/guide vane arrangement which employs radially widened regions between the flow path entrance regions and exit regions. In this embodiment overlapping between the stator sections and the rotor sections is an essential part of the flow loss reduction.

In the embodiment of the invention illustrated in FIGS. 4 and 5, there are shown two stator sections with arrays of guide vanes 54, and one rotor section with an array of drive blades 64. Between two adjacent guide vanes 54 there is a stator fluid flow path 59 which has an entrance region A and an exit region B, and between adjacent drive blades 64 there are rotor flow paths 60 each having an entrance region C and an exit region D. Between the entrance region A and exit region B of each stator flow path 59 there is a radially widened region E, and between the entrance region C and the exit region D of each rotor flow path 60 there is a radially widened region F.

As in the previously described example, the distances between adjacent guide vanes 54 are characterized by a relatively large distance $S_A$ in the entrance region A and a relatively small distance $S_B$ in the exit region B. The distance between the guide vanes 54 decreases successively along the stator flow path 59, but due to an increased radial extent of the guide vanes 54 in the widened region E the cross sectional area of the flow path is kept up in size to a point close to the exit region B. Accordingly, each guide vane 54 has radial extent $R_E$ in the widened region E which is larger than the radial extent $R_B$ in the exit region B.

In a similar way, the distance between adjacent drive blades 64 decreases successively from a large distance $S_C$ in the entrance region C to a small distance $S_D$ in the exit region D. The radial distance $R_F$ in the widened region F, however, is larger than the radial distance $R_D$ in the exit region D, which means that the cross sectional area of the rotor flow path 60 is kept up in size in the flow direction to a point close to the exit region D. This means in turn that the flow velocity is kept low during the main part of the rotor flow path 60 and is accelerated over a very short distance in the exit region D.

As described above in connection with the previous embodiment of the invention, the inner boundary of the flow paths through the stator end the rotor sections is defined by an inner surface 28. This inner surface 28 is formed by the rotor operating sections 26,27 and by the stator section or sections 15 together.

A characterising feature of the stator and rotor sections according to this embodiment of the invention is that trailing end portions 62 of the drive blades 64 and trailing end portions 52 of the guide vanes 54 are extended in the flow direction beyond those parts of the stator and rotor sections that form parts of the inner flow path defining surface 28. Moreover, the leading edges of the drive blades 64 as well as the leading edges of the guide vanes 54 are retracted in the flow direction a certain axial distance from the edge of the stator and rotor sections, respectively. An annular neck portion 65 on each rotor section and an annular neck portion 55 on each stator section is formed thereby. These annular neck portions 65, 55 on the stator sections and rotor sections, respectively, extend axially in the direction opposite the flow direction. And the extended trailing end portions 62 and 52 of the drive blades 64 and the guide vanes 54, respectively, extend over the annular neck portions 55,65 of the downstream stator or rotor sections.

This arrangement of the extended trailing portions of the drive blades 64 and the guide vanes 54 in co-operation with the annular neck portions 65, 55 of the stator and rotor sections, respectively, serves to further lower the flow resistance through the flow paths and to improve the efficiency of the turbine.

As appears from FIG. 4, the portion of the inner surface 28 that is formed by a rotor section comprises a convex portion 68 followed in flow direction by a concave portion 69, wherein the convex portion 68 is partly formed by the annular neck portion 65. In a similar way, each one of the stator section parts of the inner surface 28 comprises a convex portion 58 and a concave portion 57, wherein the convex portion 53 is partly formed by the annular neck portion 55.

FIG. 4 also illustrates that in this embodiment of the invention the outer surface 18 which defines the flow paths 29, 30 is substantially cylindrical in shape, which means that all variations in the cross sectional areas of the flow paths are accomplished by the convex and concave portions on stator and rotor section parts of the inner surface 28.

FIG. 6 shows an alternative design of the inner and outer flow path defining surfaces 18, 28. Instead of locating all of the convex and concave portions on the inner surface 28, the outer surface 18 of this alternative is formed with convex and concave portions 86, 87, 88, 89 which are located opposite the convex and concave portions 58, 57, 68, 69 on the inner surface 28. By this arrangement further possibilities are obtained to give the flow paths optimum shapes in order to improve the fluid flow characteristics through the turbine.

Still an alternative design would be to have cylindrical inner surface 18 and locating all of the convex and concave portions 58, 57, 68, 69 on the outer surface 18.

What is claimed is:

1. An axial flow turbine type rotor machine for elastic fluid operation, comprising:

a rotor having at least one axially spaced section, wherein each rotor section comprises a circumferential array of radially extending drive blades, a stator having at least two axially spaced sections, wherein each stator section comprises a circumferential array of radially extending guide vanes, and each one of said stator sections is located on opposite sides of a respective one of said at least one rotor section, wherein a rotor section flow path is formed between every two adjacent drive blades in each rotor section, and said each rotor flow path has a certain length, a rotor section entrance region, and a rotor section exit region, wherein a stator section flow path is formed between every two adjacent guide vanes in each said stator section, and said each stator flow path has a certain length, a stator section entrance region, and a stator section exit region, wherein in each said rotor section flow path said rotor section entrance region has a larger cross sectional area than said rotor section exit region, and in each said stator section flow path said stator section entrance region has a larger cross sectional area than said stator section exit region, wherein each said stator section flow path has a substantially constant cross sectional area downstream from said rotor section entrance region over at least 60% of said stator section flow path length, and wherein each said rotor section flow path has a substantially constant cross sectional area downstream from said rotor section entrance region over at least 60% of said rotor section flow path length.

2. The turbine machine according to claim 1, wherein said constant cross sectional area of each said stator section flow path extends over at least 80% of said stator section flow path length, and said constant cross sectional area of each said rotor section flow path extends over at least 80% of said rotor section flow path length.

3. An axial flow turbine type rotor machine for elastic fluid operation, comprising:

a rotor having at least one axially spaced section, wherein each rotor section comprises a circumferential array of radially extending drive blades, a stator having at least two axially spaced sections, wherein each stator section comprises a circumferential array of radially extending guide vanes, and each one of said stator sections is located on opposite sides of a respective one of said at least one rotor section, wherein a rotor section flow path is formed between every two adjacent drive blades in each rotor section, and each said rotor flow path has a certain length, a rotor section entrance region, and a rotor section exit region, wherein a stator section flow path is formed between every two adjacent guide vanes in each said stator section, and each said stator flow path has a certain length, a stator section entrance region, and a stator section exit region, wherein in each said rotor section flow path said rotor section entrance region has a larger cross sectional area than said rotor section exit region, and in each said stator section flow path said stator section entrance region has a larger cross sectional area than said stator section exit region, wherein each said rotor section flow path has a substantially constant cross sectional area downstream from said rotor section entrance region over at least 75% of said rotor section flow path length, and wherein each said stator section flow path has a substantially constant cross sectional area downstream from said stator section entrance region over at least 75% of said stator section flow path length.

4. The turbine machine according to claim 1, wherein said drive blades and said guide vanes extend radially between a substantially rotationally symmetric inner surface and a substantially rotationally symmetric outer surface, wherein each one of said rotor section flow paths has a radially widened region located between said entrance region and said exit region, and each one of said drive blades has a radial extent in said widened region that is larger than a radial extent of said drive blade in said exit region, and wherein each one of said stator section flow paths has a radially widened region located between said entrance region and said exit region, and each one of said guide vanes has a radial extent in said widened region that is larger than a radial extent of said guide vane in said exit region.

5. The turbine machine according to claim 4, wherein a part of said inner surface is formed by said rotor sections and a part of said inner surface is formed by said stator sections, wherein a trailing part of each said drive blade in each one of said rotor sections extends beyond, in a fluid flow direction, the part of said inner surface which is formed by the rotor sections, and the part of said inner surface formed by the stator sections extends beyond said guide vanes in a direction opposite the fluid flow direction, thereby forming an annular stator section neck portion on the respective stator sections, wherein said trailing part of each said drive blade in one of said rotor sections extends over said stator section neck portion of a following stator section in the fluid flow direction, wherein a trailing part of each said guide vane in each one of said stator sections extends axially beyond, in the fluid flow direction, the part of said inner surface formed by the stator sections, and the part of said inner surface formed by rotor sections extends beyond said drive blades in the direction opposite the fluid flow direction, thereby forming an annular neck portion on the respective rotor sections wherein said trailing parts of said guide vanes in one of said stator sections extend over said rotor section neck portion of a following rotor section in the fluid flow direction.

6. The turbine machine according to claim 5, wherein said exit region of each one of said rotor flow paths is formed by said trailing parts of two adjacent drive blades, and said exit region of each one of said stator flow paths is formed by said trailing parts of two adjacent guide vanes.

7. The turbine machine according to claim 5, wherein on each said rotor section said inner surface comprises a convex portion followed in the fluid flow direction by a concave portion, and said convex portion extends beyond said drive blades in a direction opposite the fluid flow direction, thereby forming said rotor section neck portion.

8. The turbine machine according to claim 5, wherein on each said stator section said inner surface has a convex portion followed in the fluid flow direction by a concave portion, and said convex portion extends beyond said guide vanes in the direction opposite the fluid flow direction, thereby forming said stator section neck portion.

9. The turbine machine according to any one of claims 4–8, wherein said outer surface is formed with at least two annular rotor flow regions each axially coinciding with one of said rotor sections, and wherein each one of said rotor flow regions comprises a convex portion followed in the fluid flow direction by a concave portion.

10. The turbine machine according to any one of claims 4–8, wherein said outer surface is formed with at least one annular stator flow region each coinciding with one of said stator sections, and wherein each one of said stator flow regions comprises a convex portion followed in the fluid flow direction by a concave portion.

11. The turbine machine according to any one of claims 1–8, wherein each said drive blade has a maximum radial extent which is not more than the length of each said drive blade in the fluid flow direction.

12. The turbine machine according to any one of claims 1–8, wherein each said guide vane has a maximum radial extent which is not more than the length of each said guide vane in the fluid flow direction.

* * * * *